US008419376B2

(12) United States Patent
Sun

(10) Patent No.: US 8,419,376 B2
(45) Date of Patent: Apr. 16, 2013

(54) PUMPING DEVICE THAT IS OPERATED EASILY AND SAFELY

(76) Inventor: Shu-Ju Sun, Madou Township, Tainan County (TW)

( * ) Notice: Subject to any disclaimer, the term of this patent is extended or adjusted under 35 U.S.C. 154(b) by 372 days.

(21) Appl. No.: 12/915,132

(22) Filed: Oct. 29, 2010

(65) Prior Publication Data

US 2012/0107161 A1 May 3, 2012

(51) Int. Cl.

| | |
|---|---|
| ***F04F 1/06*** | (2006.01) |
| ***F04B 9/14*** | (2006.01) |
| ***F04B 53/12*** | (2006.01) |
| ***B65D 83/00*** | (2006.01) |
| ***B65B 1/16*** | (2006.01) |

(52) U.S. Cl.
USPC ..... 417/118; 417/374; 417/545; 222/402; 141/67

(58) Field of Classification Search ..... 141/65, 141/67; 222/400.8, 401, 402, 400.7; 417/118, 417/374, 65, 545
See application file for complete search history.

(56) References Cited

U.S. PATENT DOCUMENTS

| | | | | |
|---|---|---|---|---|
| 984,187 | A * | 2/1911 | Bond | 222/402 |
| 7,093,624 | B2 * | 8/2006 | Chen | 141/65 |
| 7,367,366 | B2 * | 5/2008 | Liao | 141/26 |

* cited by examiner

*Primary Examiner* — Peter J Bertheaud
*Assistant Examiner* — Bryan Lettman
(74) *Attorney, Agent, or Firm* — Alan Kamrath; Kamrath IP Lawfirm, P.A.

(57) ABSTRACT

A pumping device includes a barrel, a top cover mounted on the top of the barrel, a first switching valve mounted on the top cover, a base mounted on the bottom of the barrel, a second switching valve mounted on the base, a cylinder connected between the top cover and the base, a piston movably mounted in the cylinder, a plurality of check valves mounted on the piston, an operation unit connected with the piston, and a conduit connected between the barrel and the base. Thus, a user has to pull or push the first switching valve and the second switching valve simultaneously to extract or suck the fluid in the barrel so as to deflate or inflate the barrel so that the pumping device has a security process and is operated in a safer manner.

16 Claims, 3 Drawing Sheets

PUMPING DEVICE THAT IS OPERATED EASILY AND SAFELY

BACKGROUND OF THE INVENTION

1. Field of the Invention

The present invention relates to a pumping device and, more particularly, to a pumping device for pumping a fluid, such as a gas, liquid and the like.

2. Description of the Related Art

A conventional pumping device comprises a barrel, a top cover mounted on the top of the barrel, a cylinder mounted in the barrel, a piston movably mounted in the cylinder, and an operation unit mounted on the top cover and connected with the piston to move the piston relative to the cylinder. Thus, the piston is driven by the operation unit to pump a fluid into the cylinder and the barrel. However, a user can directly control the operation unit to operate the pumping device so that the pumping device does not have a security mechanism limit the operation unit so as to prevent the user from operating the pumping device improperly.

BRIEF SUMMARY OF THE INVENTION

In accordance with the present invention, there is provided a pumping device, comprising a barrel, a top cover mounted on a top of the barrel, a first switching valve mounted on the top cover to control connection between the barrel and the top cover, a base mounted on a bottom of the barrel, a second switching valve mounted on the base to control connection between the barrel and the base, a cylinder mounted in the barrel and connected between the top cover and the base, a piston movably mounted in the cylinder, a plurality of check valves mounted on the piston to move in concert with the piston, an operation unit mounted on the top cover and connected with the piston to move the piston relative to the cylinder, and a conduit mounted in the barrel and connected between the barrel and the base.

The barrel has an inner portion provided with a receiving chamber. The top cover has an inner portion provided with a first flow channel and has a side provided with a shaft hole connected between the first flow channel and the cylinder. The first flow channel of the top cover has an upper portion provided with a first drain hole connected to an ambient environment through the top cover and has a lower portion provided with a first connecting hole connected between the first flow channel and the receiving chamber of the barrel. The first switching valve includes a first valve stem movably mounted in the first flow channel of the top cover. The first valve stem of the first switching valve has a peripheral wall provided with two first annular grooves connected to the first connecting hole and the first drain hole of the top cover respectively and has an inner portion provided with a first through hole connected between the first flow channel of the top cover and the first annular grooves. The base has an inner portion provided with a second flow channel connected to the cylinder. The second flow channel of the base has a lower portion provided with a second drain hole connected to the ambient environment through the base and has an upper portion provided with a second connecting hole connected between the second flow channel and the conduit. The second switching valve includes a second valve stem movably mounted in the second flow channel of the base. The second valve stem of the second switching valve has a peripheral wall provided with two second annular grooves connected to the second drain hole and the second connecting hole of the base respectively and has an inner portion provided with a second through hole connected between the second flow channel of the base and the second annular grooves. The cylinder has an inner portion provided with a piston chamber connected between the top cover and the base. The piston chamber of the cylinder has an upper end connected to the first flow channel of the top cover through the shaft hole and has a lower end connected to the second flow channel of the base. The conduit has an upper end connected to the receiving chamber of the barrel and a lower end connected to the second connecting hole of the base so that the second connecting hole of the base is connected to the receiving chamber of the barrel through the conduit.

The primary objective of the present invention is to provide a pumping device that is operated easily and safely.

According to the primary advantage of the present invention, a user has to pull or push the first switching valve and the second switching valve simultaneously to extract or suck the fluid in the barrel so as to deflate or inflate the receiving chamber of the barrel so that the pumping device has a security process and is operated in a safer manner.

According to another advantage of the present invention, the fluid is circulated in the receiving chamber of the barrel so that the pumping device is operated easily and conveniently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
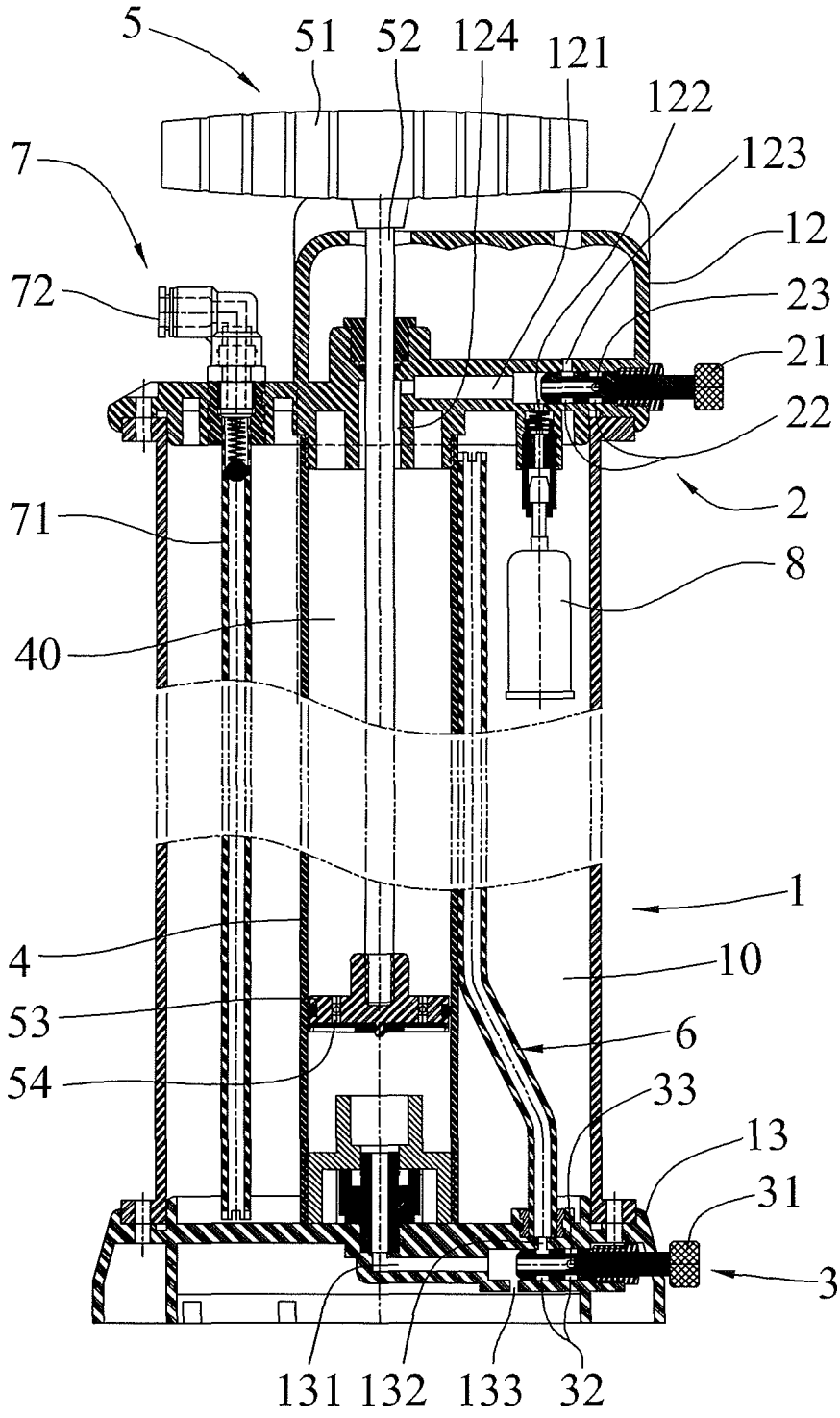
FIG. 1 is a front cross-sectional view of a pumping device in accordance with the preferred embodiment of the present invention.

Referring to the drawings and initially to FIG. 1, a pumping device in accordance with the preferred embodiment of the present invention comprises a barrel 1, a top cover 12 mounted on a top of the barrel 1, a first switching valve 2 mounted on the top cover 12 to control connection between the barrel 1 and the top cover 12, a base 13 mounted on a bottom of the barrel 1, a second switching valve 3 mounted on the base 13 to control connection between the barrel 1 and the base 13, a cylinder 4 mounted in the barrel 1 and connected between the top cover 12 and the base 13, a piston 53 movably mounted in the cylinder 4, a plurality of check valves 54 mounted on the piston 53 to move in concert with the piston 53, an operation unit 5 mounted on the top cover 12 and connected with the piston 53 to move the piston 53 relative to the cylinder 4, a conduit 6 mounted in the barrel 1 and connected between the barrel 1 and the base 13, a delivery unit 7 mounted on the top cover 12 and connected to the barrel 1, and a pressure release unit 8 mounted in the barrel 1 and connected to the top cover 12.

The barrel 1 has an inner portion provided with a receiving chamber 10 to receive the cylinder 4, the conduit 6, the delivery unit 7 and the pressure release unit 8.

The top cover 12 has an inner portion provided with a first flow channel 121 and has a side provided with a shaft hole 124 connected between the first flow channel 121 and the cylinder 4. The first flow channel 121 of the top cover 12 has an upper portion provided with a first drain hole 123 connected to the ambient environment through the top cover 12 and has a lower portion provided with a first connecting hole 122 connected between the first flow channel 121 and the receiving chamber 10 of the barrel 1.

The first switching valve 2 includes a first valve stem 21 movably mounted in the first flow channel 121 of the top cover 12. The first valve stem 21 of the first switching valve 2 has a peripheral wall provided with two first annular grooves 22 connected to the first connecting hole 122 and the first drain hole 123 of the top cover 12 respectively and has an inner portion provided with a first through hole 23 connected between the first flow channel 121 of the top cover 12 and the first annular grooves 22.

The base 13 has an inner portion provided with a second flow channel 131 connected to the cylinder 4. The second flow channel 131 of the base 13 has a lower portion provided with a second drain hole 133 connected to the ambient environment through the base 13 and has an upper portion provided with a second connecting hole 132 connected between the second flow channel 131 and the conduit 6.

The second switching valve 3 includes a second valve stem 31 movably mounted in the second flow channel 131 of the base 13. The second valve stem 31 of the second switching valve 3 has a peripheral wall provided with two second annular grooves 32 connected to the second drain hole 133 and the second connecting hole 132 of the base 13 respectively and has an inner portion provided with a second through hole 33 connected between the second flow channel 131 of the base 13 and the second annular grooves 32.

The cylinder 4 is received in the receiving chamber 10 of the barrel 1 and has an inner portion provided with a piston chamber 40 connected between the top cover 12 and the base 13. The piston chamber 40 of the cylinder 4 has an upper end connected to the first flow channel 121 of the top cover 12 through the shaft hole 124 and has a lower end connected to the second flow channel 131 of the base 13. Thus, the second flow channel 131 of the base 13 is connected to the first flow channel 121 of the top cover 12 through the piston chamber 40 of the cylinder 4 and the shaft hole 124 of the top cover 12.

The piston 53 is movable in the piston chamber 40 of the cylinder 4 and is limited between the top cover 12 and the base 13. The check valves 54 are received in the piston chamber 40 of the cylinder 4. Each of the check valves 54 only allows the fluid in the piston chamber 40 of the cylinder 4 to flow from up to down.

The operation unit 5 includes a propeller shaft 52 movably mounted in the piston chamber 40 of the cylinder 4 and having a lower end connected with the piston 53 to move the piston 53 and an upper end protruding outward from the top cover 12, and a grip portion 51 mounted on the upper end of the propeller shaft 52 to move the propeller shaft 52 relative to the cylinder 4. The propeller shaft 52 of the operation unit 5 extends through the shaft hole 124 of the top cover 12.

The conduit 6 has an upper end connected to the receiving chamber 10 of the barrel 1 and a lower end connected to the second connecting hole 132 of the base 13 so that the second connecting hole 132 of the base 13 is connected to the receiving chamber 10 of the barrel 1 through the conduit 6.

The delivery unit 7 includes a pipe 71 mounted in the receiving chamber 10 of the barrel 1 and having a lower end connected to the receiving chamber 10 of the barrel 1 and an upper end attached to the top cover 12, and a connector 72 mounted on the top cover 12 and connected to the upper end of the pipe 71. The connector 72 of the delivery unit 7 protrudes outward from the top cover 12 and is externally connected to a container (not shown).

The pressure release unit 8 is received in the receiving chamber 10 of the barrel 1 and has an upper end connected to the first connecting hole 122 of the top cover 12 and a lower end connected to the receiving chamber 10 of the barrel 1. The upper end of the pressure release unit 8 is attached to the top cover 12.

Figure 2:
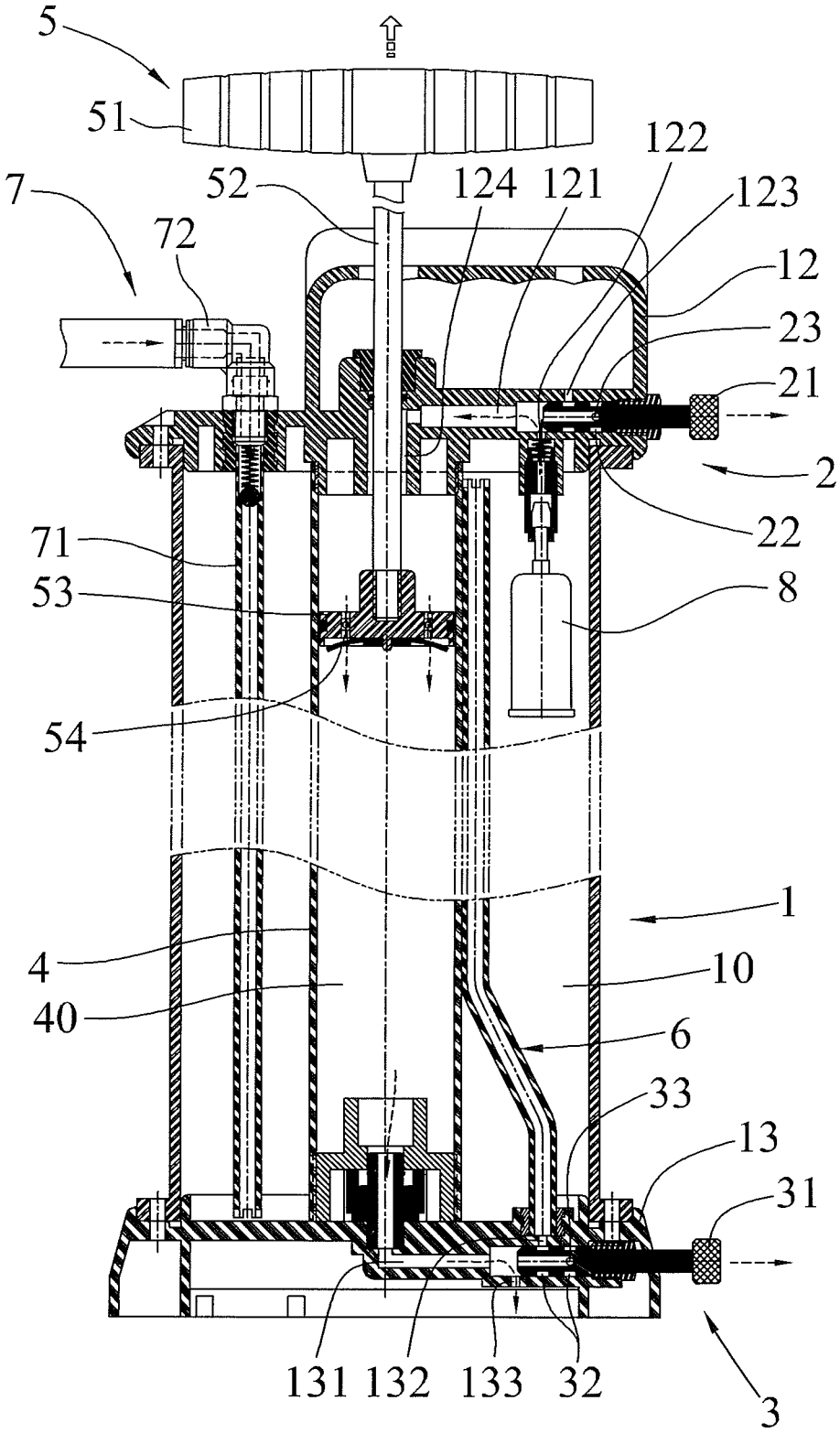
FIG. 2 is a schematic operational view of the pumping device as shown in FIG. 1 in use.

In operation, referring to FIG. 2 with reference to FIG. 1, when the first valve stem 21 of the first switching valve 2 is pulled outward relative to the top cover 12, the first valve stem 21 of the first switching valve 2 is detached from the first connecting hole 122 of the top cover 12 so that the first connecting hole 122 of the top cover 12 is connected to the first flow channel 121 of the top cover 12, and the receiving chamber 10 of the barrel 1 is connected to the first flow channel 121 of the top cover 12 through the first connecting hole 122 of the top cover 12. At the same time, when the second valve stem 31 of the second switching valve 3 is pulled outward relative to the base 13, the second valve stem 31 of the second switching valve 3 is detached from the second drain hole 133 of the base 13 so that the second drain hole 133 of the base 13 is connected to the second flow channel 131 of the base 13, and the piston chamber 40 of the cylinder 4 is connected to the second drain hole 133 of the base 13 through the second flow channel 131 of the base 13.

In such a manner, when the piston 53 is moved upward in the piston chamber 40 of the cylinder 4 by pulling the grip portion 51 of the operation unit 5, the piston chamber 40 of the cylinder 4 under the piston 53 is evacuated to form a vacuum suction force, so that the fluid in the receiving chamber 10 of the barrel 1 is drawn by the vacuum suction force to flow through the first connecting hole 122, the first flow channel 121 and the shaft hole 124 of the top cover 12 into the piston chamber 40 of the cylinder 4. Then, the fluid passes through the check valves 54, the piston chamber 40 of the cylinder 4, the second flow channel 131 and the second drain hole 133 of the base 13 and is drained outward from the second drain hole 133 of the base 13.

Thus, when the piston 53 is moved upward and downward in the piston chamber 40 of the cylinder 4 in a reciprocal manner, the fluid in the receiving chamber 10 of the barrel 1 is drained outward successively so that the receiving chamber 10 of the barrel 1 is evacuated gradually to form a vacuum state. At this time, when the connector 72 of the delivery unit 7 is externally connected to a container, the fluid in the container is sucked and drawn successively into the receiving chamber 10 of the barrel 1 by the vacuum suction force in the receiving chamber 10 of the barrel 1.

Figure 3:
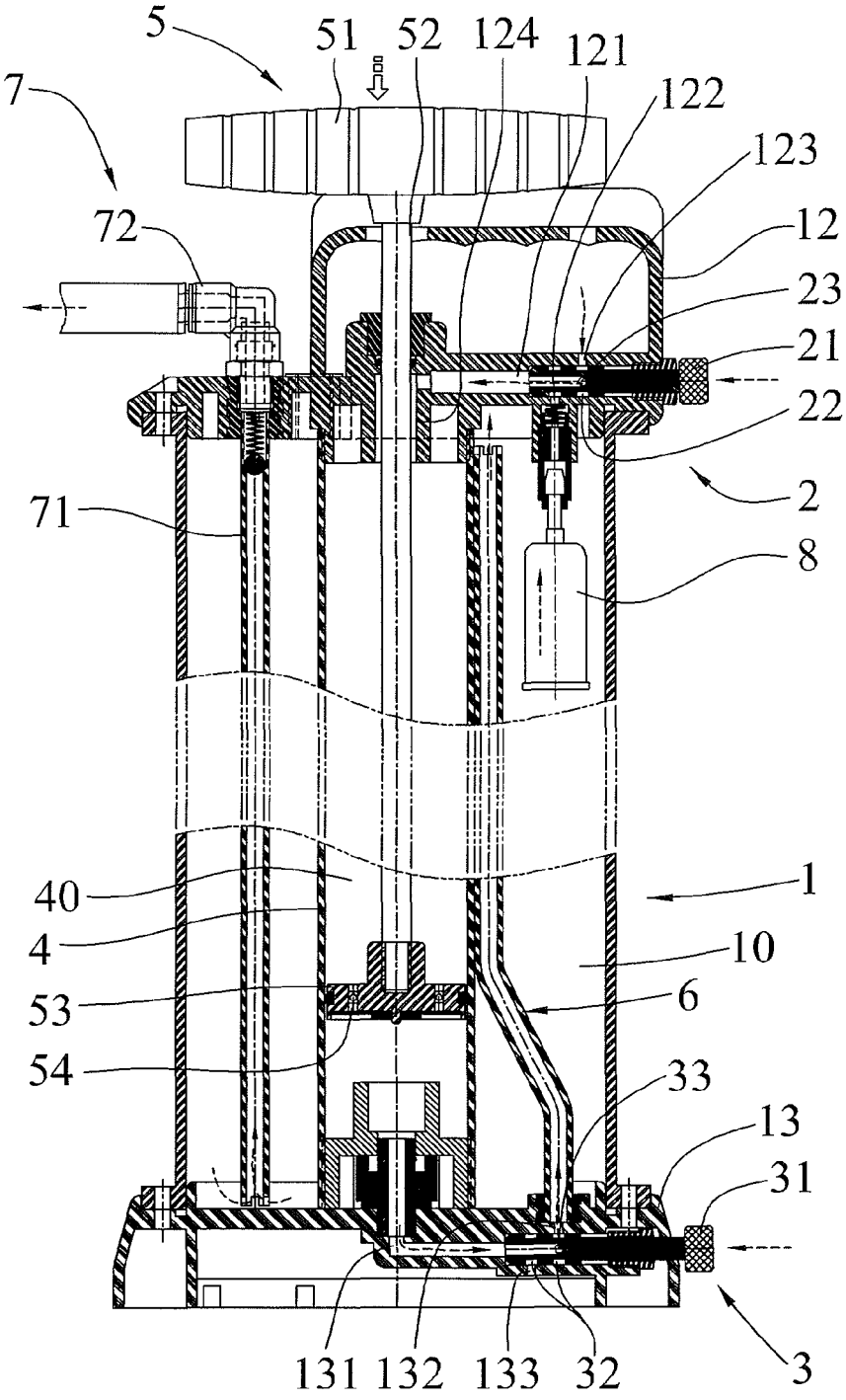
FIG. 3 is a schematic operational view of the pumping device as shown in FIG. 1 in use.

On the contrary, referring to FIG. 3 with reference to FIG. 1, when the first valve stem 21 of the first switching valve 2 is pressed toward to the top cover 12, the first valve stem 21 of the first switching valve 2 is moved to block the first connecting hole 122 of the top cover 12 to interrupt the connection between the first connecting hole 122 and the first flow channel 121 of the top cover 12. At this time, when the first valve stem 21 of the first switching valve 2 is pressed toward to the top cover 12, the first annular grooves 22 of the first switching valve 2 are moved to connect the first drain hole 123 of the top cover 12 so that the first drain hole 123 of the top cover 12 is connected to the first flow channel 121 of the top cover 12 through the first annular grooves 22 and the first through hole 23 of the first switching valve 2. At the same time, when the second valve stem 31 of the second switching valve 3 is pressed toward the base 13, the second valve stem 31 of the second switching valve 3 is moved to block the second drain hole 133 of the base 13 to interrupt the connection between the second flow channel 131 and the second drain hole 133 of the base 13. At this time, when the second valve stem 31 of the second switching valve 3 is pressed toward the base 13, the second annular grooves 32 of the second switching valve 3 are moved to connect the second connecting hole 132 of the base 13 so that the second connecting hole 132 of the base 13 is connected to the second flow channel 131 of the base 13 through the second annular grooves 32 and the second through hole 33 of the first switching valve 2.

In such a manner, when the piston 53 is moved downward in the piston chamber 40 of the cylinder 4 by pushing the grip portion 51 of the operation unit 5, the fluid in the piston chamber 40 of the cylinder 4 is compressed by the piston 53 to flow through the second flow channel 131 of the base 13, the second through hole 33 and the second annular grooves 32 of the first switching valve 2, and the second connecting hole 132 of the base 13 into the conduit 6 and to flow through the conduit 6 into the receiving chamber 10 of the barrel 1. At the same time, when the piston 53 is moved downward in the piston chamber 40 of the cylinder 4, the piston chamber 40 of the cylinder 4 above the piston 53 forms a suction force so that the fluid in the ambient environment is drawn to pass through the base 13, the first drain hole 123 of the top cover 12, the first annular grooves 22 and the first through hole 23 of the first switching valve 2 into the first flow channel 121 of the top cover 12. Then, the fluid in the first flow channel 121 of the top cover 12 flows through the shaft hole 124 of the top cover 12 into the piston chamber 40 of the cylinder 4.

Thus, when the piston 53 is moved upward and downward in the piston chamber 40 of the cylinder 4 in a reciprocal manner, the fluid in the ambient environment is sucked and drawn successively into the receiving chamber 10 of the barrel 1 so that the fluid is stored in the receiving chamber 10 of the barrel 1. At this time, when the connector 72 of the delivery unit 7 is externally connected to a container, the fluid in the receiving chamber 10 of the barrel 1 is delivered through the delivery unit 7 into the container. In addition, when the pressure in the receiving chamber 10 of the barrel 1 exceeds a predetermined value, the pressure release unit 8 is pushed upward to connect the receiving chamber 10 of the barrel 1 to the first connecting hole 122 of the top cover 12 so that the air in the receiving chamber 10 of the barrel 1 partially flows through the first connecting hole 122 of the top cover 12, the first annular grooves 22 and the first through hole 23 of the first switching valve 2 into the first flow channel 121 of the top cover 12 to achieve a pressure release function.

Accordingly, a user has to pull or push the first switching valve 2 and the second switching valve 3 simultaneously to extract or suck the fluid in the barrel 1 so as to deflate or inflate the receiving chamber 10 of the barrel 1 so that the pumping device has a security process and is operated in a safer manner. In addition, the fluid is circulated in the receiving chamber 10 of the barrel 1 so that the pumping device is operated easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A pumping device, comprising:

a barrel;

a top cover mounted on a top of the barrel;

a first switching valve mounted on the top cover to control connection between the barrel and the top cover;

a base mounted on a bottom of the barrel;

a second switching valve mounted on the base to control connection between the barrel and the base;

a cylinder mounted in the barrel and connected between the top cover and the base;

a piston movably mounted in the cylinder;

a plurality of check valves mounted on the piston to move in concert with the piston;

an operation unit mounted on the top cover and connected with the piston to move the piston relative to the cylinder; and a conduit mounted in the barrel and connected between the barrel and the base, wherein the barrel has an inner portion provided with a receiving chamber;

the top cover has an inner portion provided with a first flow channel and has a side provided with a shaft hole connected between the first flow channel and the cylinder;

the first flow channel of the top cover has an upper portion provided with a first drain hole connected to an ambient environment through the top cover and has a lower portion provided with a first connecting hole connected between the first flow channel and the receiving chamber of the barrel;

the first switching valve includes a first valve stem movably mounted in the first flow channel of the top cover;

the first valve stem of the first switching valve has a peripheral wall provided with two first annular grooves connected to the first connecting hole and the first drain hole of the top cover respectively and has an inner portion provided with a first through hole connected between the first flow channel of the top cover and the first annular grooves;

the base has an inner portion provided with a second flow channel connected to the cylinder;

the second flow channel of the base has a lower portion provided with a second drain hole connected to the ambient environment through the base and has an upper portion provided with a second connecting hole connected between the second flow channel and the conduit;

the second switching valve includes a second valve stem movably mounted in the second flow channel of the base;

the second valve stem of the second switching valve has a peripheral wall provided with two second annular grooves connected to the second drain hole and the second connecting hole of the base respectively and has an inner portion provided with a second through hole connected between the second flow channel of the base and the second annular grooves;

the cylinder has an inner portion provided with a piston chamber connected between the top cover and the base;

the piston chamber of the cylinder has an upper end connected to the first flow channel of the top cover through the shaft hole and has a lower end connected to the second flow channel of the base;

the conduit has an upper end connected to the receiving chamber of the barrel and a lower end connected to the second connecting hole of the base so that the second connecting hole of the base is connected to the receiving chamber of the barrel through the conduit.

2. The pumping device of claim 1, wherein the pumping device further comprises:

a delivery unit mounted on the top cover and connected to the barrel.

3. The pumping device of claim 2, wherein the delivery unit includes:

a pipe mounted in the receiving chamber of the barrel and having a lower end connected to the receiving chamber of the barrel and an upper end attached to the top cover; and a connector mounted on the top cover and connected to the upper end of the pipe.

4. The pumping device of claim 3, wherein the connector of the delivery unit protrudes outward from the top cover.

5. The pumping device of claim 1, wherein the pumping device further comprises:

a pressure release unit mounted in the barrel and connected to the top cover.

6. The pumping device of claim 5, wherein the pressure release unit is received in the receiving chamber of the barrel and has an upper end connected to the first connecting hole of the top cover and a lower end connected to the receiving chamber of the barrel.

7. The pumping device of claim 6, wherein the upper end of the pressure release unit is attached to the top cover.

8. The pumping device of claim 1, wherein the operation unit includes:

a propeller shaft movably mounted in the piston chamber of the cylinder and having a lower end connected with the piston to move the piston and an upper end protruding outward from the top cover; and a grip portion mounted on the upper end of the propeller shaft to move the propeller shaft relative to the cylinder.

9. The pumping device of claim 8, wherein the propeller shaft of the operation unit extends through the shaft hole of the top cover.

10. The pumping device of claim 1, wherein the cylinder is received in the receiving chamber of the barrel.

11. The pumping device of claim 1, wherein the second flow channel of the base is connected to the first flow channel of the top cover through the piston chamber of the cylinder and the shaft hole of the top cover.

12. The pumping device of claim 1, wherein the piston is movable in the piston chamber of the cylinder.

13. The pumping device of claim 1, wherein the piston is limited between the top cover and the base.

14. The pumping device of claim 1, wherein the check valves are received in the piston chamber of the cylinder;

each of the check valves only allows the fluid in the piston chamber of the cylinder to flow from up to down.

15. The pumping device of claim 1, wherein when the first valve stem of the first switching valve is pulled outward relative to the top cover, the first valve stem of the first switching valve is detached from the first connecting hole of the top cover so that the first connecting hole of the top cover is connected to the first flow channel of the top cover, and the receiving chamber of the barrel is connected to the first flow channel of the top cover through the first connecting hole of the top cover;

when the second valve stem of the second switching valve is pulled outward relative to the base, the second valve stem of the second switching valve is detached from the second drain hole of the base so that the second drain hole of the base is connected to the second flow channel of the base, and the piston chamber of the cylinder is connected to the second drain hole of the base through the second flow channel of the base.

16. The pumping device of claim 1, wherein when the first valve stem of the first switching valve is pressed toward to the top cover, the first valve stem of the first switching valve is moved to block the first connecting hole of the top cover to interrupt a connection between the first connecting hole and the first flow channel of the top cover;

when the first valve stem of the first switching valve is pressed toward to the top cover, the first annular grooves of the first switching valve are moved to connect the first drain hole of the top cover so that the first drain hole of the top cover is connected to the first flow channel of the top cover through the first annular grooves and the first through hole of the first switching valve;

when the second valve stem of the second switching valve is pressed toward the base, the second valve stem of the second switching valve is moved to block the second drain hole of the base to interrupt a connection between the second flow channel and the second drain hole of the base;

when the second valve stem of the second switching valve is pressed toward the base, the second annular grooves of the second switching valve are moved to connect the second connecting hole of the base so that the second connecting hole of the base is connected to the second flow channel of the base through the second annular grooves and the second through hole of the second switching valve.

* * * * *